US010344399B2

(12) United States Patent
Rutledge et al.

(10) Patent No.: US 10,344,399 B2
(45) Date of Patent: Jul. 9, 2019

(54) GEL-ELECTROSPINNING PROCESS FOR PREPARING HIGH-PERFORMANCE POLYMER NANOFIBERS

(71) Applicant: Massachusetts Institute of Technology, Cambridge, MA (US)

(72) Inventors: Gregory C. Rutledge, Newton, MA (US); Jay Hoon Park, Cambridge, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 163 days.

(21) Appl. No.: 15/290,499

(22) Filed: Oct. 11, 2016

(65) Prior Publication Data

US 2017/0101726 A1 Apr. 13, 2017

Related U.S. Application Data

(60) Provisional application No. 62/315,289, filed on Mar. 30, 2016, provisional application No. 62/239,310, filed on Oct. 9, 2015.

(51) Int. Cl.

| | |
|---|---|
| ***D01D 1/02*** | (2006.01) |
| ***D01D 10/02*** | (2006.01) |
| ***D01D 5/00*** | (2006.01) |
| ***D01F 6/04*** | (2006.01) |
| ***D01D 1/09*** | (2006.01) |

(52) U.S. Cl.

CPC ..... *D01D 5/003* (2013.01); *D01D 1/09* (2013.01); *D01D 5/0038* (2013.01); *D01F 6/04* (2013.01); *D10B 2321/0211* (2013.01); *D10B 2401/06* (2013.01)

(58) Field of Classification Search

CPC ..... D01D 1/02; D01D 1/09; D01D 5/0038; D01D 10/02; D01F 6/04; D10B 2321/0211

USPC ..... 264/10, 211.17, 464, 465, 466, 484

See application file for complete search history.

(56) References Cited

U.S. PATENT DOCUMENTS

| | | | | |
|---|---|---|---|---|
| 2007/0018361 | A1 | 1/2007 | Xu | |
| 2010/0056007 | A1* | 3/2010 | Rabolt ..... | D01D 1/02 264/465 X |
| 2010/0059907 | A1 | 3/2010 | Dee et al. | |
| 2012/0171488 | A1 | 7/2012 | Yeo et al. | |
| 2013/0131765 | A1* | 5/2013 | Polkinghorne ..... | A61N 1/04 607/115 |
| 2017/0101726 | A1 | 4/2017 | Rutledge et al. | |

OTHER PUBLICATIONS

International Search Report and Written Opinion for International Application No. PCT/US16/56398 dated Jun. 27, 2017.

Jao et al., "Novel elastic nanofibers of syndiotactic polypropylene obtained from electrospinning," Eur Polym J, 54: 181-189 (2014).

Wang et al., "Solution-electrospun isotactic polypropylene fibers: processing and microstructure development during stepwise annealing," Macromolecules, 43(21): 9022-9029 (2010).

* cited by examiner

*Primary Examiner* — Leo B Tentoni

(74) *Attorney, Agent, or Firm* — Dana M. Gordon; Foley Hoag LLP

(57) ABSTRACT

Disclosed are methods of forming a plurality of fibers, and nanofibers produced from such a method.

14 Claims, 15 Drawing Sheets

A

B

A

B

A

B

C

A

B

A

B

C

D

A

B

GEL-ELECTROSPINNING PROCESS FOR PREPARING HIGH-PERFORMANCE POLYMER NANOFIBERS

RELATED APPLICATIONS

This application claims the benefit of priority to U.S. Provisional Patent Application Ser. No. 62/239,310, filed Oct. 9, 2015; and U.S. Provisional Patent Application Ser. No. 62/315,289, filed Mar. 30, 2016. The contents of each of which are hereby incorporated by reference in their entirety.

GOVERNMENT SUPPORT

This invention was made with Government support under Contract No. W911NF-13-D-0001 awarded by the Army Research Office. The Government has certain rights in the invention.

BACKGROUND

Over the past two decades, electrospinning has attracted great interest from the academic and industrial scientific communities due to its capability for continuous fabrication of ultrafine fibers having diameters from a few nanometers to a few microns (commonly known as "nanofibers"). Unlike conventional fiber spinning processes, the fabrication of these sub-micron fibers is driven by electrical forces rather than mechanical forces, and often involves in high uniaxial extensional strain rates up to 1000 $s^{-1}$. These fibers can be produced from a wide range of organic and inorganic materials and typically have extremely high specific surface areas, owing to their nanometer-scale fiber diameters. The structural and functional versatility of these fibers, in addition to the economic viability of the process at the laboratory scale, has allowed their use in a broad range of applications (e.g., membranes and filters, battery materials, sensors, biomaterials, drug delivery). In these applications, the mechanical integrity of the electrospun material determines whether it will hold up under end-use conditions that involve stress and strain. Typical Young's moduli of submicron-diameter electrospun fiber range from about 0.1 GPa to about 7 GPa, which are larger than those of the bulk material but still less than those of many conventional synthetic fibers. Moreover, these nanofibers are unable to withstand tearing or rupture under normal conditions of use (e.g., in apparel). Indeed, fiber durability has remained one of the biggest limitations of electrospun fibers for years that has prevented its use in applications such as chemical and biological protection membranes, coatings for electromagnetic interference (EMI) shielding on equipment and personnel, and ultralight-weight protective gear for soldiers. Use of the ultrafine fibers in high performance applications, such as transparent composites, soft body armor, industrial protective clothing or structural cords and ropes, will benefit from increases in their stiffness, strength, and/or toughness.

Thus, there exists a need for nanofibers with improved mechanical properties, and reliable methods of producing such nanofibers.

SUMMARY

In one aspect, disclosed herein is a method of forming a plurality of fibers, comprising the steps of (i) placing a polymer solution in a vessel comprising a spinneret; wherein the polymer solution comprises a polymer and a solvent, the polymer solution has a gelation temperature and a viscosity, the solvent has a boiling point, the temperature of the polymer solution in the vessel is in the range from the boiling point of the solvent to the gelation temperature, and the viscosity of the polymer solution is less than about 150 Poise; and (ii) electrostatically drawing the polymer solution through the spinneret into an electric field, wherein the temperature of the polymer solution as it is drawn through the spinneret is in the range from about 15° C. below the gelation temperature to the gelation temperature, thereby depositing a plurality of fibers on a collection surface; wherein the spinneret is separated from the collection surface by a space.

In another aspect, the present disclosure relates to nanofibers made by any of the methods disclosed herein.

DETAILED DESCRIPTION

Overview

Figure 1:
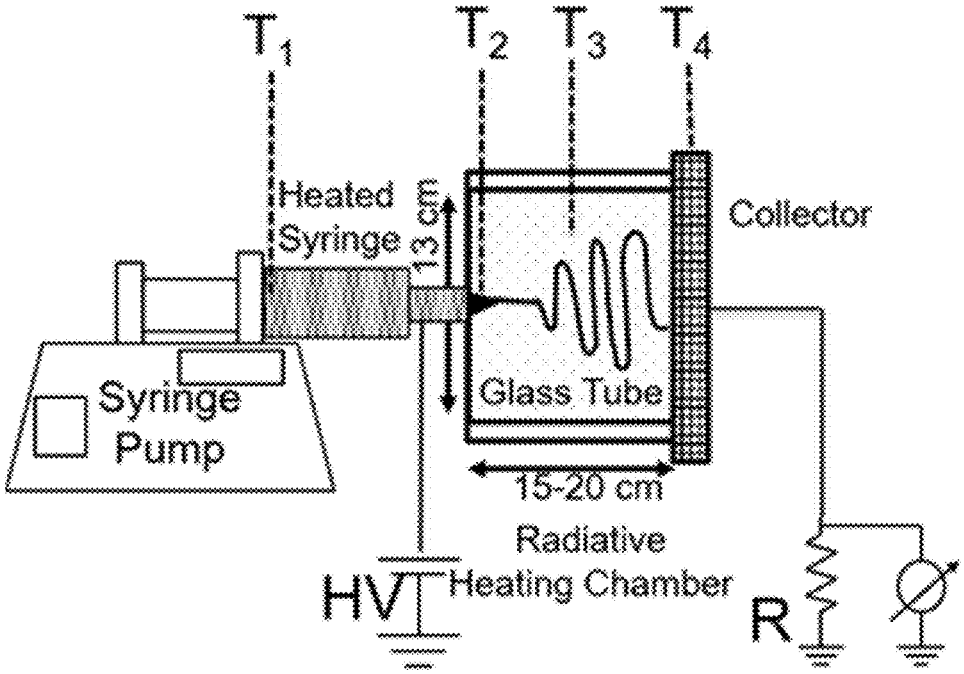
FIG. 1 includes two panels (Panels A and B). Panel A shows an apparatus set-up for gel-electrospinning. $T_1$=Solution reservoir temperature, $T_2$=Extruded jet temperature, $T_3$=Space temperature around jet, $T_4$=collector temperature. Panel B is a schematic of a molecular organization within the gel-electrospinning process. As shown in Panel B, the molecules are dilute and entangled at the extruder exit, but crystallized and oriented at the collector. At $T_2$, a semi-dilute entangled UHMWPE solution is shown. At $T_3$, extensional strain of a gel-state UHWPE is shown. At $T_4$, highly crystalline submicron PE fibers are shown.
Figure 1:
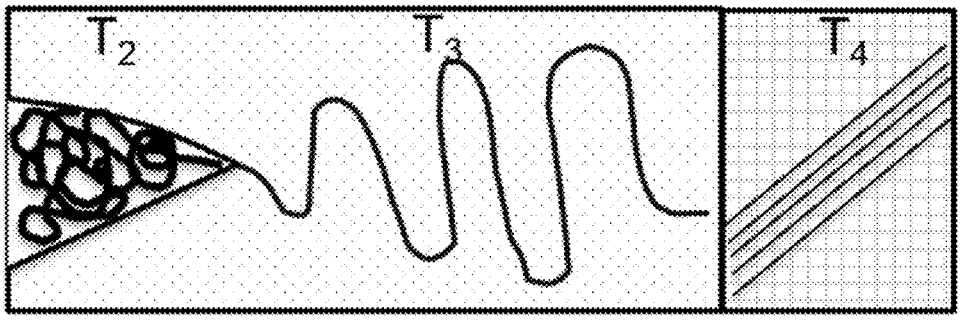

In certain embodiments, the invention relates to a method of gel-electrospinning. FIG. 1 shows a diagram of an exemplary gel-electrospinning apparatus. In certain embodiments, the methods disclosed herein process at the edge of gelation to afford high elongation and molecular ordering in the electrospun fibers produced. While not wishing to be bound by theory, this molecular ordering results in nanofibers with exceptional mechanical properties.

To fabricate nanofibers (e.g., UHMWPE nanofibers) continuously with a high degree of molecular orientation and crystallinity, in one aspect the method disclosed herein replaced the hydraulic extrusion process of gel-spinning with the electrostatically drawn filament-forming process of electrospinning, and the subsequent mechanical hot drawing stage with electrostatically driven drawing and whipping processes at elevated temperature. Unlike conventional electrospinning, which is often operated at a room temperature, certain embodiments of the method disclosed herein operate at elevated temperatures chosen to induce the formation of a gel solution within the filament during drawing. In certain embodiments, the gel-electrospinning method disclosed herein operates at a higher extensional strain rate (~1000 $s^{-1}$) than that of a conventional gel-spinning process (~1 $s^{-1}$). In certain embodiments, the electrostatically driven hot drawing of a gel polymer solution occurs predominantly in the whipping region (typically occurs in $T_3$ zone of FIG. 1) of an electrospinning process.

In certain embodiments of the methods disclosed herein, control over the temperature zones (FIG. 1) and an understanding of the polymer solution gel rheology are ideal. As disclosed herein, the range of temperatures for gel-electrospinning may differ from one temperature zone to another. The four temperature zones, as labeled in FIG. 1, are: solution reservoir ($T_1$), the extruded jet ($T_2$), the space around the jet ($T_3$), and the collector ($T_4$).

In certain embodiments, the operable temperature window for each zone varies based on the gelation temperature ($T_{gel}$) of the solution. $T_{gel}$ can typically be obtained from rheological experimental data (see e.g., Example 6 and FIG. 2, Panel A).

As used herein, the "gelation temperature" is the maximum temperature at which a polymer solution forms a gel. Above the gelation temperature, a polymer solution ceases to exist in a gel state.

As used herein, a "gel" is a three dimensional cross-linked network that swells in a solvent to a certain finite extent, but does not dissolve in even a good solvent.

Exemplary Methods

In certain embodiments, the invention relates to a method of forming a plurality of fibers, comprising the steps of:

- placing a polymer solution in a vessel comprising a spinneret; wherein the polymer solution comprises a polymer and a solvent, the polymer solution has a gelation temperature and a viscosity, the solvent has a boiling point, the temperature of the polymer solution in the vessel is in the range from the boiling point of the solvent to the gelation temperature, and the viscosity of the polymer solution is less than about 150 Poise; and
- electrostatically drawing the polymer solution through the spinneret into an electric field, wherein the temperature of the polymer solution as it is drawn through the spinneret is in the range from about 15° C. below the gelation temperature to the gelation temperature, thereby depositing a plurality of fibers on a collection surface; wherein the spinneret is separated from the collection surface by a space.

In certain embodiments, the viscosity of the polymer solution in the vessel is less than about 125 Poise or less than about 100 Poise.

In certain embodiments, the temperature of the polymer solution in the vessel is in the range from about 40° C. above the gelation temperature to the gelation temperature, the temperature of the polymer solution in the vessel is in the range from about 35° C. above the gelation temperature to the gelation temperature, the temperature of the polymer solution in the vessel is in the range from about 30° C. above the gelation temperature to the gelation temperature, the temperature of the polymer solution in the vessel is in the range from about 25° C. above the gelation temperature to the gelation temperature, the temperature of the polymer solution in the vessel is in the range from about 20° C. above the gelation temperature to the gelation temperature, the temperature of the polymer solution in the vessel is in the range from about 15° C. above the gelation temperature to the gelation temperature, the temperature of the polymer solution in the vessel is in the range from about 10° C. above the gelation temperature to the gelation temperature, from about 5° C. above the gelation temperature to the gelation temperature, from about 15° C. above the gelation temperature to about 5° C. above the gelation temperature, from about 15° C. above the gelation temperature to about 10° C. above the gelation temperature, or from about 10° C. above the gelation temperature to about 5° C. above the gelation temperature.

In certain embodiments, the temperature of the polymer solution as it is drawn through the spinneret is in the range from about 10° C. below the gelation temperature to the gelation temperature, from about 5° C. below the gelation temperature to the gelation temperature, from about 15° C. below the gelation temperature to about 5° C. below the gelation temperature, from about 15° C. below the gelation temperature to about 10° C. below the gelation temperature, or from about 10° C. below the gelation temperature to about 5° C. below the gelation temperature.

In certain embodiments, the methods disclosed herein further comprise applying heat to the space between the spinneret and the collection surface.

In certain embodiments, the polymer solution is heated in the vessel.

In certain embodiments, the polymer solution is heated prior to being placed in the vessel. In certain embodiments, prior to being placed in the vessel the polymer solution is heated to a temperature in the range from its gelation temperature to the boiling point of the solvent.

In certain embodiments, the space between the spinneret and the collection surface is heated to a space temperature in the range from about 15° C. below the gelation temperature to the gelation temperature, from about 10° C. below the gelation temperature to the gelation temperature, from about 5° C. below the gelation temperature to the gelation temperature, from about 15° C. below the gelation temperature to about 5° C. below the gelation temperature, from about 15° C. below the gelation temperature to about 10° C. below the gelation temperature, or from about 10° C. below the gelation temperature to about 5° C. below the gelation temperature.

In certain embodiments of the methods disclosed herein, a positive electrical potential is maintained on the spinneret, and a negative electrical potential is maintained on the collection surface.

In certain embodiments, the polymer solution comprises ultra-high molecular weight polyethylene (UHMWPE).

In certain embodiments, the solvent comprises decalin, o-dichlorobenzene, p-xylene, cyclohexanone, or paraffin oil. In certain embodiments, the solvent is a mixture of p-xylene and cyclohexanone. In certain embodiments, the solvent is p-xylene.

In certain embodiments of the methods disclosed herein, the collection surface is at a temperature in the range from about 15° C. below the gelation temperature to the gelation temperature, from about 10° C. below the gelation temperature to the gelation temperature, from about 5° C. below the gelation temperature to the gelation temperature, from about 15° C. below the gelation temperature to about 5° C. below the gelation temperature, from about 15° C. below the gelation temperature to about 10° C. below the gelation temperature, or from about 10° C. below the gelation temperature to about 5° C. below the gelation temperature.

In certain embodiments, the invention relates to any one of the aforementioned methods, wherein the polymer solution further comprises a salt. In certain embodiments, the salt is tetra-butyl ammonium bromide (t-BAB) or tetra-butylammonium hydrogen sulfate (t-BAHS). In certain embodiments, the salt is tetra-butyl ammonium bromide (t-BAB).

In certain embodiments, to electrostatically draw the polymer solution through the spinneret a high voltage is applied to the polymer solution such that a charged meniscus forms at the spinneret, which emits a jet when the voltage is above a critical value. In certain embodiments, the electric voltage is about 1 kV to about 100 kV.

Exemplary Fibers

In certain embodiments, the invention relates to a nanofiber made by any one of the methods disclosed herein.

In certain embodiments, the diameter of the nanofiber is about 1 nm to about 1 μm, about 10 nm to about 1 μm, about 100 nm to about 1 μm, about 10 nm to about 500 nm, or about 100 nm to about 500 nm.

In certain embodiments, the Young's modulus of the fiber is in the range from about 85 GPa to about 1000 GPa, from about 90 GPa to about 1000 GPa, from about 95 GPa to about 1000 GPa, or from about 100 GPa to about 1000 GPa.

In certain embodiments, the yield stress of the fiber is in the range from about 2 GPa to about 100 GPa, from about 3 GPa to about 100 GPa, from about 4 GPa to about 100 GPa, from about 5 GPa to about 100 GPa, from about 6 GPa to about 100 GPa, or from about 7 GPa to about 100 GPa.

EXEMPLIFICATION

The invention now being generally described, it will be more readily understood by reference to the following examples, which are included merely for purposes of illustration of certain aspects and embodiments of the invention, and are not intended to limit the invention.

Example 1—UHMWPE Solution Characterization

Ultra high molecular weight polyethylene (UHMWPE) with a molecular weight of 2000 kg $mol^{-1}$ was purchased from Ticona. p-xylene and t-BABs were both purchased from Sigma-Aldrich. Typically, a solution consisted of 1 wt % UHMWPE with 0.02 t-BABs dissolved in p-xylene. The solution was mixed at a room temperature and immediately put on a heated (~120° C.) stirrer for at least 2 hours. The crystallization and melting temperatures of the polymer in solution were obtained by differential scanning calorimetry (DSC, TA Instruments). The first cooling cycle began from 130° C. to 40° C., and the following heating cycle brought the temperature back up to 130° C. The heating and cooling rates were fixed at 1° C. $min^{-1}$. A rheometer (AR-2000, TA Instruments) was used to measure the viscosity of the polymer solution as a function of temperature. To prevent the loss of the volatile p-xylene solvent during rheometry at elevated temperature (T>100° C.), a solvent trap filled with p-xylene was used. A temperature sweep from 120° C. to 40° C. with a constant shear rate of 1 rad $s^{-1}$ was performed. An oscillatory shear with the same temperature range sweep at a fixed shear rate of 1 rad $s^{-1}$ was also performed to obtain the elastic and storage moduli.

Example 2—UHMWPE Nanofiber Fabrication

To fabricate high performance nanofibers continuously, the gel-electrospinning process was divided into four zones. In each zone, the temperature was chosen judiciously based on knowledge of the polymer solution gel rheology, and care was taken to control the temperature within each zone. The four zones are: the solution reservoir, the extruder exit, the draw zone, which includes both steady jet and whipping regions, and the collector. FIG. 1, Panel A shows an apparatus for the gel-electrospinning of UHMWPE. The temperatures of the zones are labelled $T_1$ through $T_4$ in FIG. 1, Panel A. FIG. 1, Panel B shows a schematic of the molecular organization within a hypothetical gel-electrospinning process; the molecules are dilute and entangled at the extruder exit, but crystallized and oriented at the collector. In the apparatus, $T_1$ and $T_3$ were controlled independently using a ceramic band heater and a space heater, respectively. $T_2$ was found to be equal or slightly below $T_1$ ($T_2-T_1 \leq 10°$ C.). $T_3$ and $T_4$ stayed mostly equal throughout the duration of the experiments, with the biggest difference observed at any point being $T_3=T_4+5°$ C.

To fabricate a UHMWPE Nanofiber, a spinning solution comprising UHMWPE (1 wt %), p-xylene, and t-BABs (0.2 wt %) was used. The solution was mixed at room temperature and immediately put on a heated (~120° C.) stirrer for 2 hours. The solution was then transferred to a pre-heated glass syringe (Cadence Science, 20 mL). A band heater (Plastic Processing Equipment) was used to heat the solution-filled syringe. A Macor ceramic encasing was used as an electrical insulator between the heater and the needle, while still providing a good thermal conductivity and ability to withstand a maximum process temperature of 170° C. A cylindrical ceramic space heater (Omega Engineering) was used to heat the space around the needle.

For an optimal electrospinning condition, the temperature of four process zones (FIG. 1) were set at $T_1=T_2=130°$ C., while $T_3$ and $T_4$ were varied from 20° C. to 130° C. The volumetric flow of the feed solution, controlled by a syringe pump (Harvard apparatus), was controlled from 0.02 ml/min to 0.2 ml/min. A negative electrical potential (−10 to −15 kV) was used on the collector while a positive potential (+15 to 20 kV) was maintained on the spinneret. The distance from the tip of the needle to the collector was fixed at 300 mm.

Example 3—Electron Microscopy Characterization

A JEOL 6010LA scanning electron microscope (SEM) was used to observe the fiber and mat morphology and to measure the fiber diameter. Prior to the sample loading, the electrospun fibers were sputter-coated with Au for 30 seconds. A Tecnai T-12 transmission electron microscope (TEM) was used to observe the single fiber structure and diameter. The UHMWPE fibers were placed on a standard copper grid, and subsequently observed under the TEM.

Figure 3:
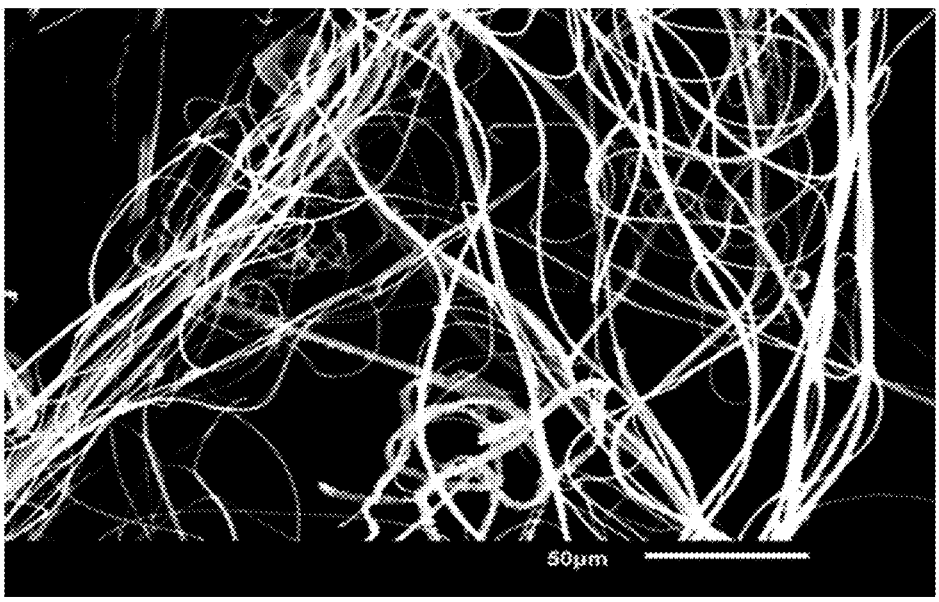
FIG. 3 includes two panels (Panels A and B). Panel A is a SEM image of a typical gel-electrospun UHMWPE web collected at a temperature $T_3$=80° C. The scale bar represents 50 μm. Panel B is a series of TEM images of individual electrospun UHMWPE nanofibers. The scale bars represent 50 nm, 200 nm, 100 nm, and 250 nm, respectively starting from the upper left image. Note that the images presented in FIG. 3, Panel B were collected from the samples in FIG. 3, Panel A.
Figure 3:
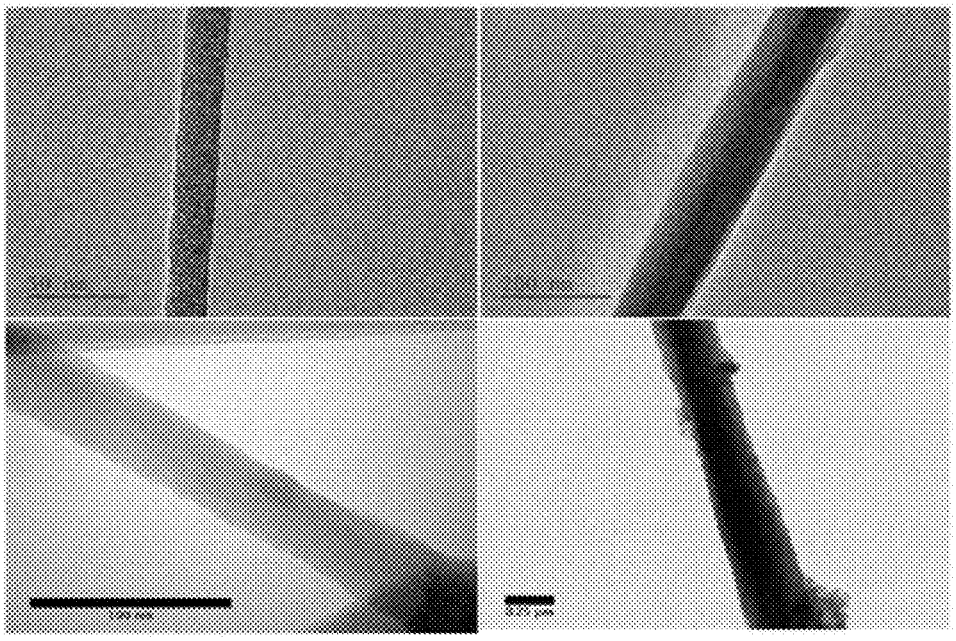
Figure 7:
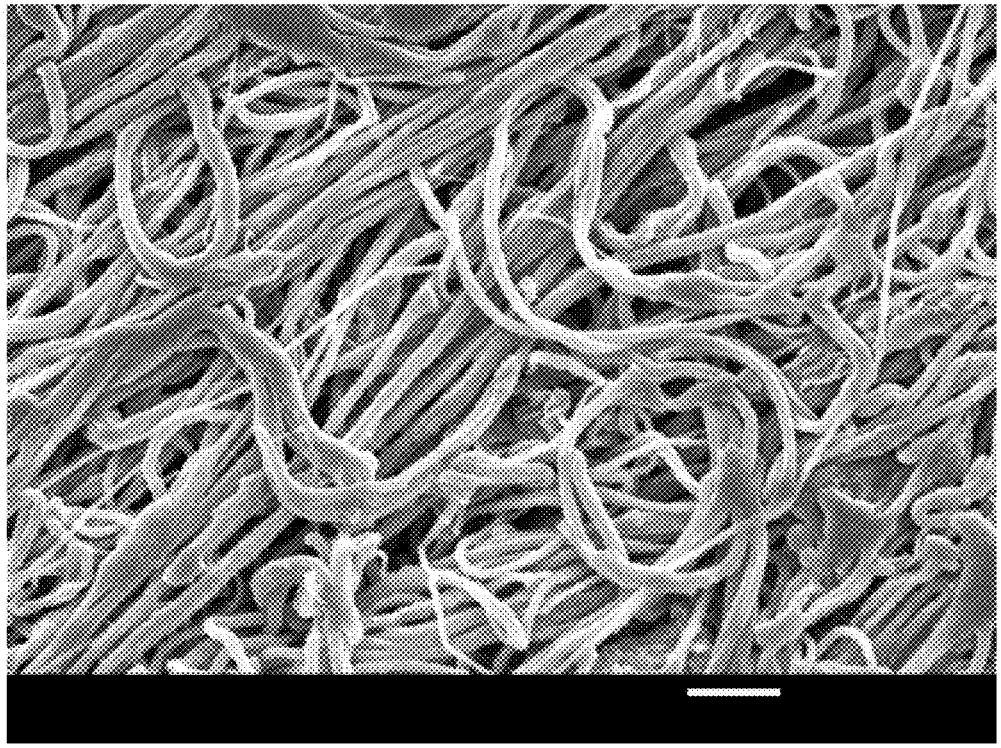
FIG. 7 is a SEM image of a typical gel-electrospun UHMWPE fiber mat.

FIG. 7 shows a SEM image of a gel-electrospun UHMWPE fiber mat fabricated over a period of 120 minutes (98 mg total mass). FIG. 3, Panel A shows a UHMWPE fiber bundle of 8 mg fabricated over 10 minutes with this procedure. FIG. 3, Panel B shows TEM images of the individual UHMWPE fibers. The mean diameter and distribution of FIG. 7 were 2.12±0.92 μm, while those of FIG. 3, Panel b were 1.41±0.60 μm. As seen in FIG. 3, Panel B, some of the individual fibers among the fiber mat are ultra-thin (e.g., submicron), ranging from 10's of nm to 200 nm. The smallest fiber observed here was about 20 nm (e.g., 0.025 μm), which is within an order of magnitude to a single orthorhombic PE crystal size and is similar to a core size of polyethylene shish-kebab structures. Presumably, these particularly thin UHMWPE fibers have undergone high uniaxial extensional strain rate of ~1000 $s^{-1}$ or more.

Example 4—Crystal Characterization

DSC was used to obtain the overall degree of crystallinity. The following equation was used to calculate the percent crystallinity, X:

$$X = \frac{\Delta H_m - \Delta H_c}{\Delta H_m^\circ}$$

where $\Delta H_m$ was obtained by integrating the melting peak from the heating cycle, and $\Delta H^\circ_m$ is the specific enthalpy of fusion of polyethylene. Since cold crystallization was not observed, $\Delta H_c=0$. The General Area Detector Diffraction System (GADDS, Bruker) was used to measure the wide-angle X-ray diffraction pattern of the fiber bundles. The degree of crystallinity was obtained by integrating the relative intensities of the crystalline peaks with amorphous halos.

Example 5—Fiber Mechanical Measurements

Figure 6:
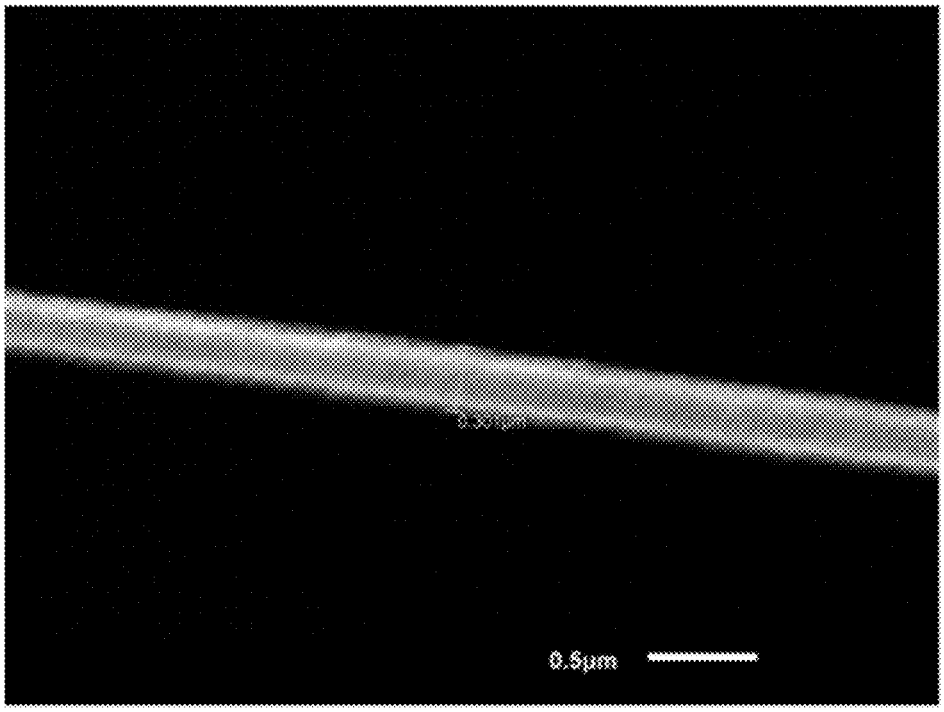
FIG. 6 includes two panels (Panels A and B). Panel A is an SEM image of an individual gel-electrospun UHMWPE fiber with an approximate diameter of 350 nm. Panel B is a plot showing the stress-strain curve of the fiber from Panel A.
Figure 6:
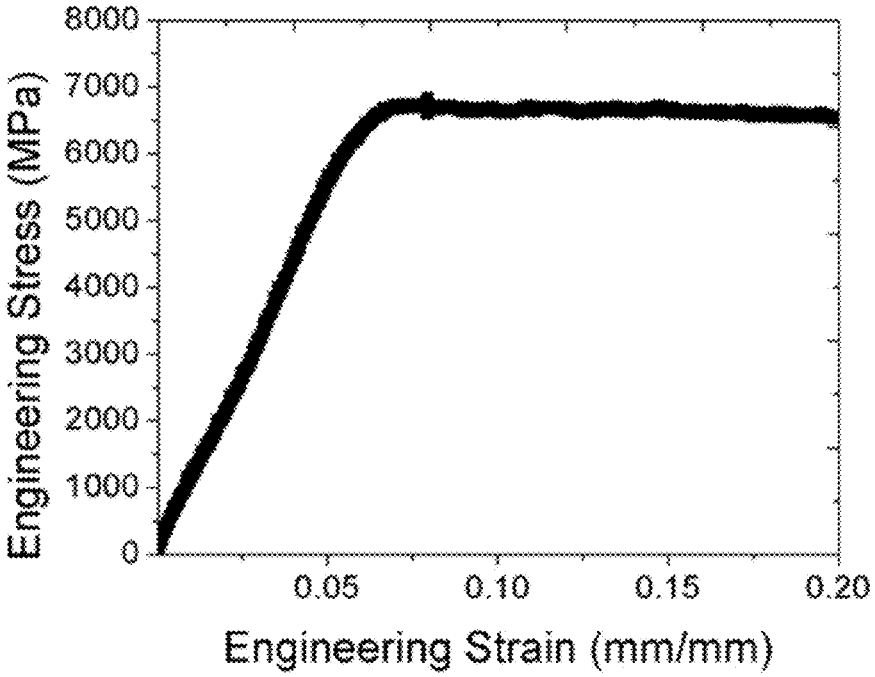

A single-fiber mechanical test was performed using a U9815A T150 Universal Testing Machine ("Nano-UTM", Agilent Technologies) which is also known as the Nano-UTM. The tensile test method was directly adopted from the previous work of Pai et al. on measuring the single fiber tensile properties of PA(6) T. (See C. L. Pai, M. C. Boyce, G. C. Rutledge, *Polymer* 2011, 52, 2295). The force was measured as a function of the extensional strain for individual electrospun fibers in uniaxial tension at a strain rate of $10^{-3}$ $s^{-1}$. The Young's modulus was determined by linear regression of the stress-strain curve from the origin to a low strain of about 0.01. Following Pai et al.'s protocol, the undeformed section of the fiber was observed under SEM after sputter-coating to examine its diameter. The diameters of five different sections were measured to determine the fiber diameter and its variability within the individual fiber (see FIG. 6). It should be noted that if the standard deviation of the five measurements for an individual fiber was greater than 20%, the data point was discarded.

Figure 4:
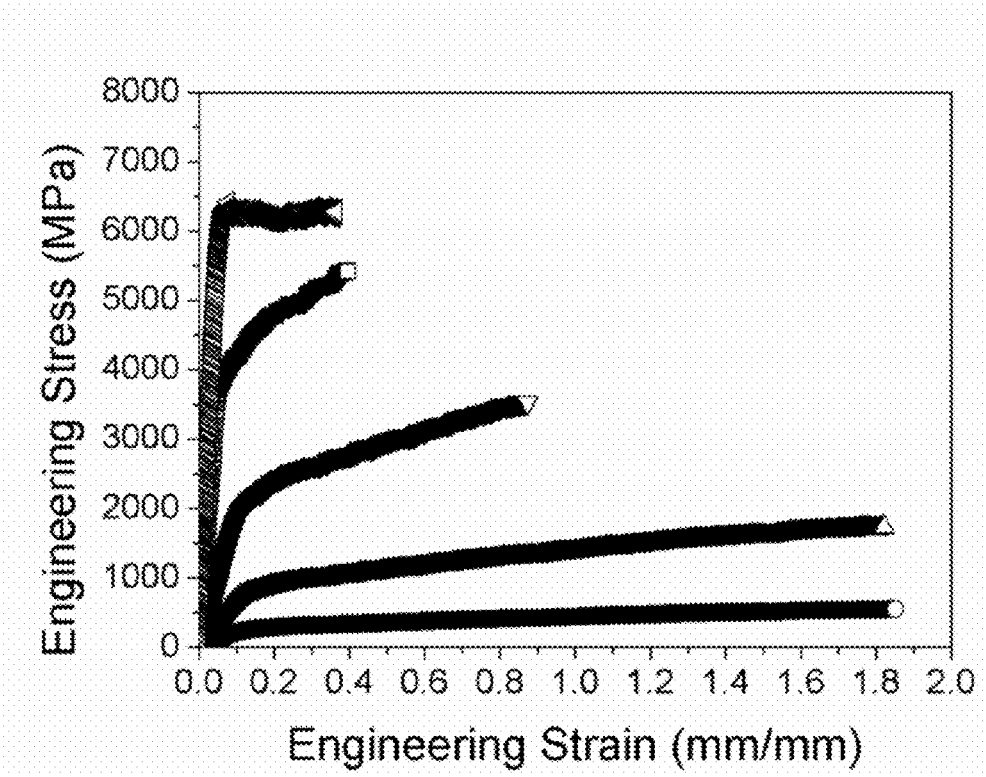
FIG. 4 includes four panels (Panels A-D). Panel A is a plot showing representative stress-strain curves for UHMWPE fiber diameters of 0.49 (◁), 0.73 (□), 0.91 (▽), 1.05 (Δ), and 2.31 μm (○). Panel B is a plot of Young's modulus vs fiber diameter. The insert shows the same data on a log-log scale. The solid line at Young's modulus=0.728 GPa, is the bulk UHMWPE modulus. The dotted line is an empirically fitted line (Equation 1). Panel C is a plot of the electrospun fiber diameter vs the yield stress. The insert shows the same data on a log-log scale. The solid line at yield stress=0.02 GPa is the bulk UHMWPE value. Panel D is a plot of WAXD patterns of UHMWPE nanofiber bundles, with average fiber diameters ~0.9±0.2 μm.
Figure 4:
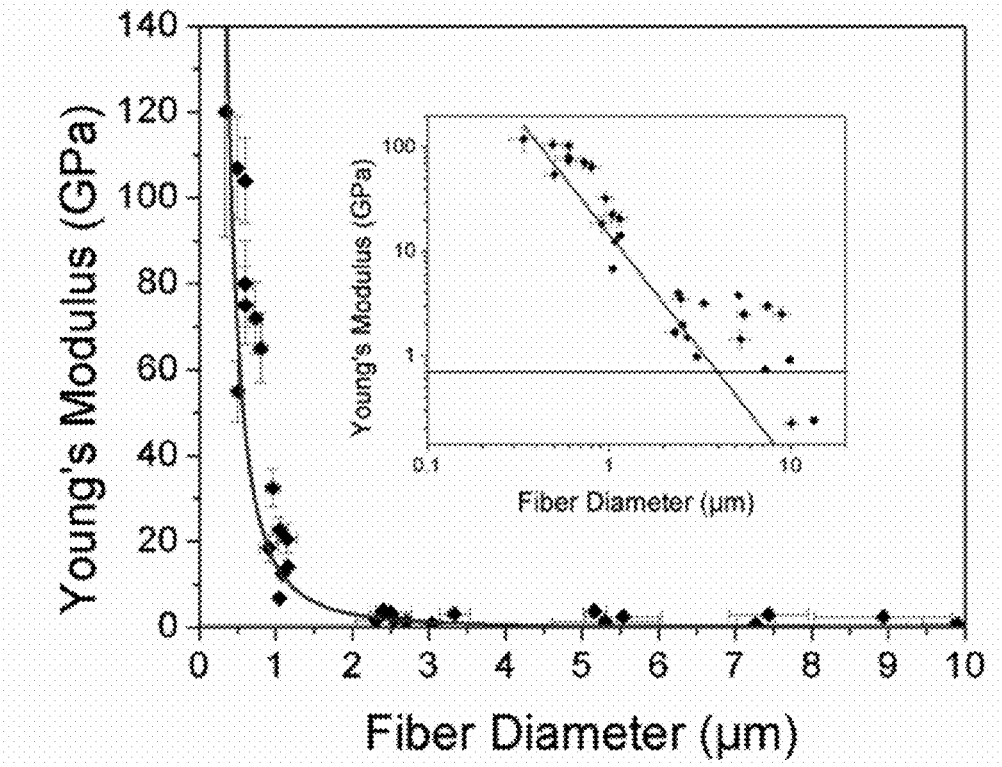
Figure 4:
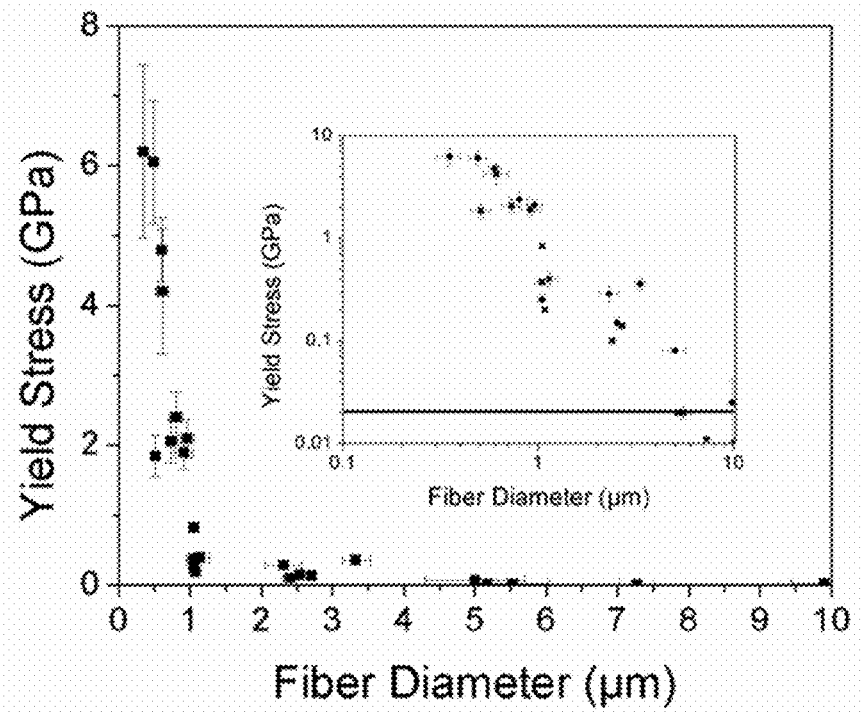
Figure 4:
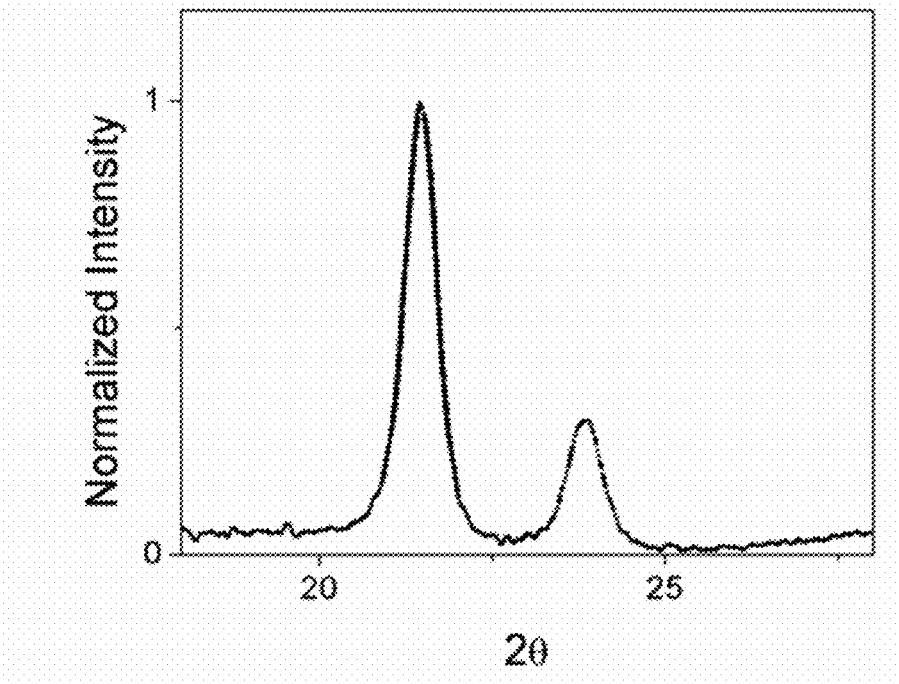

FIG. 4, Panel A shows the representative stress-strain curves for gel-electrospun UHMWPE fibers with diameters of 0.49, 0.73, 0.91, 1.05, and 2.31 μm. As seen here, the linear regression slope from the origin to a strain of 0.01 mm/mm increased dramatically for fibers whose diameters were nearly as small as 1 μm, and was even higher for those whose diameters were submicron. The Young's moduli are plotted against fiber diameters in FIG. 4, Panel B which shows a dramatic increase in Young's modulus as the fiber diameter decreases below one micron. Many of the submicron UHMWPE fibers yielded relatively high Young's moduli, above 30 GPa, which was expected as the higher extensional strain obtained by the electrical gel-drawing would likely induce the smaller fiber diameter. Fibers with d≤0.60 μm exhibited moduli above 100 GPa In particular, the Young's modulus of the 0.35±0.05 μm fiber was 120±24 GPa, which is the highest reported modulus for a single fiber produced by any electrostatically-driven jetting process, and is comparable to that of a commercial high performance Spectra® (see Table 1). It should be noted that due to the irregularity of some of the fiber diameters, the Young's modulus values displayed a relatively significant margin of error as much as 15%. Since the Young's modulus is inversely proportional to ($d^{-2}$ a slight variation in smaller fiber diameters (d<1 μm) significantly affected the moduli error bar. Despite the slight deviations of the reported data, the mean Young's modulus of the smaller fibers (d<1 μm) was 73±4 GPa, which is two orders of magnitude higher than the bulk modulus of UHMWPE. Up to ~500× improvement of modulus with the size reduction of fiber from 10.1 μm to 0.35 μm was also observed, which is the largest improvement of modulus by diameter reduction reported for any electrostatically-driven jetting process.

These gel-electrospun fibers also exhibited higher yield stress as the fiber diameter was decreased, as shown in FIG. 4, Panel C. The magnitude of yield stress improvement with size reduction of the largest to the smallest fiber was about 600×. The mean yield stress of the smaller fibers (d<1 μm) was 3.5±0.2 GPa, which is two orders of magnitude higher than the bulk of UHMWPE value and similar to a typical ultimate tensile strength of a Spectra® fiber. Since the tensile strength is generally greater than the yield stress, this implies that both the fiber strength and modulus of the smallest gel-electrospun nanofibers are comparable to or higher than those of a commercial high performance microfiber. In fact, as shown in Table 1, the ultimate tensile strength of the UHMWPE fibers with d=0.73 and 0.49 μm were both about 1.5× the reported tensile strength of a Spectra®. The toughness, on the other hand, did not show a clear trend of change with respect to decreasing fiber diameter below 1 μm. Due to its highly crystalline nature, the elongation at break decreased with reduction of fiber diameter, or yielded more brittle behavior. However, the decreased flexibility is still offset by the increased strength, hence the toughness remained to be approximately 2.0 GPa in all smaller fibers. These toughness values are three times greater than the highest toughness reported, and exhibit much higher strain at break than most other high performance fibers which does not exceed ~4%.

TABLE 1

Mechanical properties for selected electrospun UBMWPE fibers over a range of diameters, compared with a typical Spectra ® fiber.

| Fiber Diameter (μm) | Young's Modulus (GPa) | Strength (GPa) | Toughness (GPa) | Strain at Break |
|---|---|---|---|---|
| 0.49 ± 0.05 | 110 ± 16 | 6.3 ± 0.9 | 2.1 ± 0.3 | 0.36 |
| 0.73 ± 0.08 | 72 ± 11 | 5.4 ± 0.8 | 1.7 ± 0.3 | 0.40 |
| 0.91 ± 0.12 | 19 ± 4 | 3.5 ± 0.7 | 2.3 ± 0.8 | 0.87 |
| 1.05 ± 0.03 | 6.85 ± 0.28 | 1.73 ± 0.07 | 2.33 ± 0.09 | 1.82 |
| 2.31 ± 0.26 | 1.68 ± 0.27 | 0.55 ± 0.09 | 0.75 ± 0.12 | 1.85 |
| 10.0 (Spectra ®) | 133 | 3.68 | — | 0.03 |

Example 6—Determination of Temperature Ranges for an Electrical Gel-Drawing

To promote gel-drawing in the whipping zone ($T_3$ of FIG. 1), the polymer solution is in a semi-dilute state, or a gel-state, in the whipping region. At the same time, the gel viscosity is around 100 Poise or lower to promote spinnability. The viscoelasticity of a polymer solution heavily depends on the solvent, concentration, molecular weight of the solute, and temperature. From preliminary gel-electrospinning experiments (see example 8), p-xylene/UHMWPE solution yielded the highest production rate among the good PE solvents, and relatively monodisperse small fiber diameter sizes.

Figure 2:
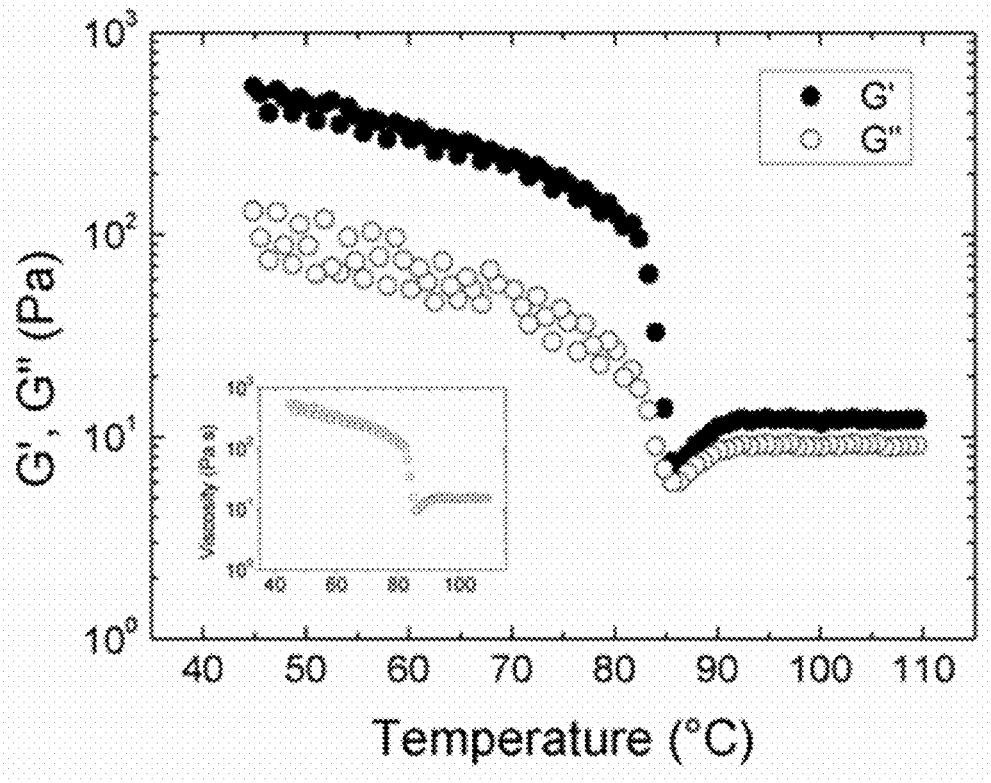
FIG. 2 includes three panels (Panels A-C). Panels A and B are plots of oscillatory shear data showing the storage and loss modulus with respect to temperature at a fixed oscillatory stress of 0.88 Pa (Panel A) and a fixed strain of 0.05 (Panel B). The inset plots show the viscosities (open squares) with respect to temperature. Panel C is a plot showing the mean and standard deviation of gel-electrospun ultra high molecular weight polyethylene (UHMWPE) fiber diameters at a various range of operating temperatures for $T_3$ from FIG. 1.
Figure 2:
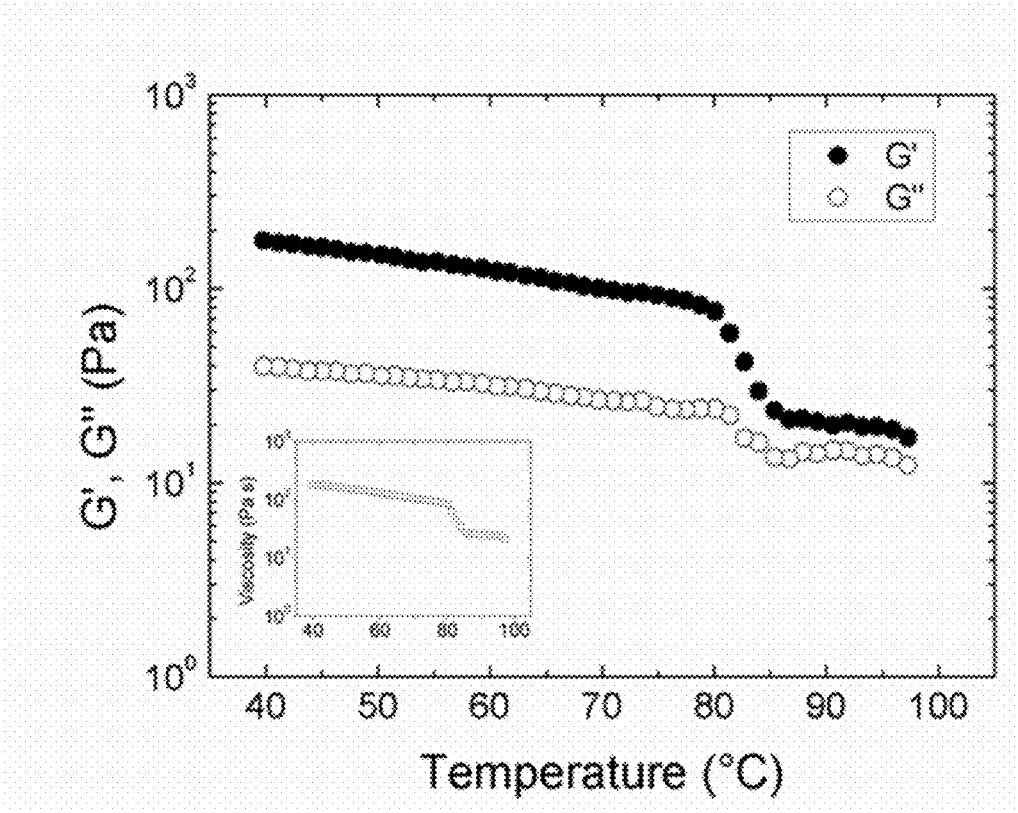
Figure 2:
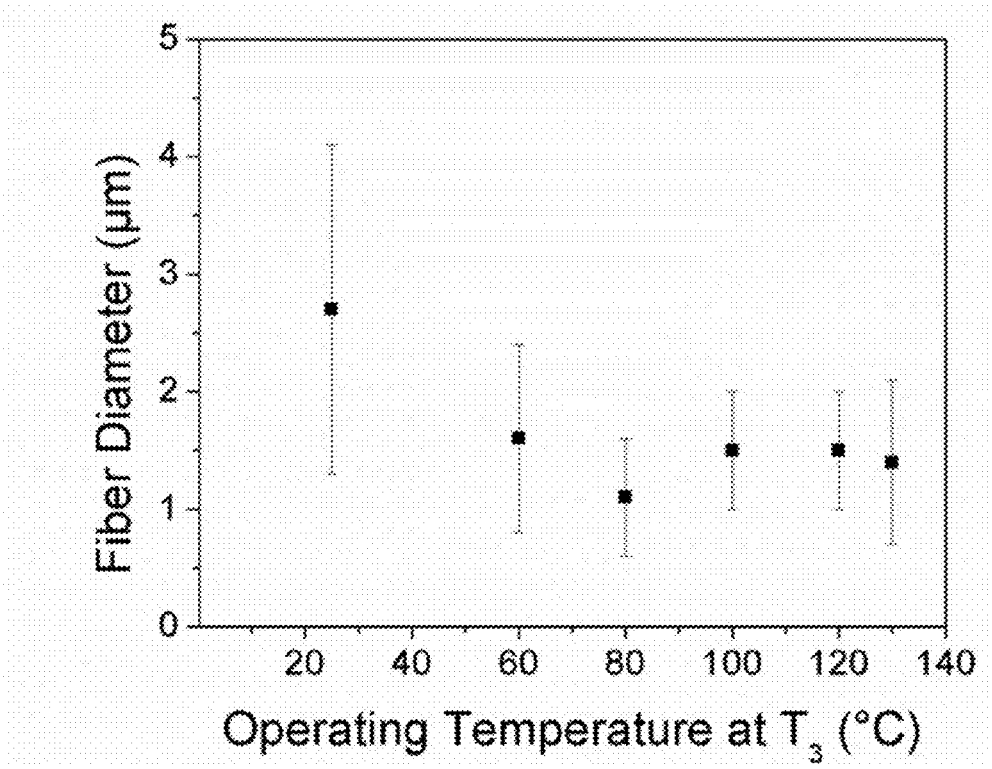
Figure 5:
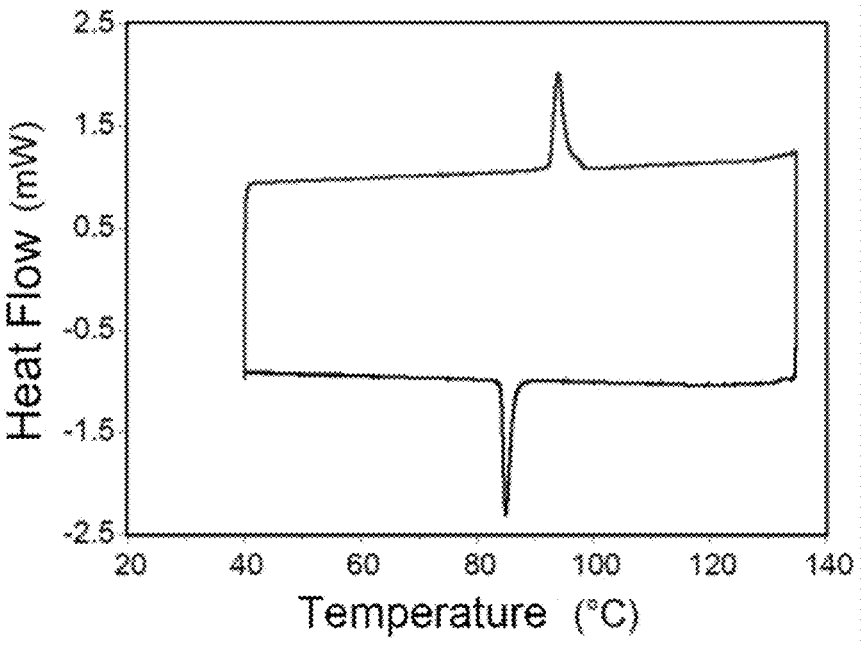
FIG. 5 is a plot of Differential Scanning calorimeter (DSC) data of p-xylene/UHMWPE 1 wt % solution.

FIG. 2, Panel A, and FIG. 2, Panel B, show the complex viscoelastic behaviors of 1 wt % p-xylene/UHMWPE solution at a constant oscillatory stress (0.88 Pa) and a constant strain (5%), respectively. While cooling down, the differences between storage (G') and loss moduli (G") at each temperature were kept fairly constant until T=84.8° C. (FIG. 2, Panel A) and T=84.7° C. (FIG. 2, Panel B). At these respective points, a drastic transition of steepened slopes of storage and loss modulus was observed, followed by subsequent declines of the slopes at T=81.7° C. (FIG. 2*a*) and T=81.4° C. (FIG. 2, Panel B). Below this temperature, G' was about an order of magnitude larger than G". The onset temperatures of the sol-gel transition observed from the rheological experiments closely matched the onset transitional temperature of 84.1° C. from the cooling cycle of p-xylene/UHMWPE solution from DSC (c.f. FIG. 5). Based on these results, the onset of thermoreversible gel formation, or $T_{gel}$, was determined to be approximately between 84-85° C. The solution viscosity, η, was η≤100 Pas when T≥80° C. (cf. FIG. 2, Panel A, and FIG. 2, Panel B). A viscosity of 100 Pa•s or lower is considered desirable for continuous fiber spinning.

Based on these findings, the desired temperature within the draw zone for gel-electrospinning was determined to be 80° C.≤T≤85° C. The spinning solution was then gel-electrospun at various values of $T_3$ and $T_4$, while all of the other parameters were held constant at values unless stated otherwise. FIG. 2, Panel C shows the mean fiber diameter and its distribution as a function of $T_3$. The mean fiber diameter clearly decreased as $T_3$ was increased from room temperature to 80° C. This reduction of fiber diameter is due to the decrease in solution viscosity up to ~80° C. (c.f. FIG. 2, Panel A). Above 80° C., relatively similar means and standard deviations of fiber diameter were observed. Although the viscosity decreased by an order of magnitude above T=80° C. (c.f. FIG. 2, Panel A), the solution was no longer in a gel-state, thus it was difficult to observe any obvious reduction of fiber diameter due to the viscosity differences between the sol and gel states. The UHMWPE fibers that were collected at $T_3$=80° C. showed the smallest mean fiber diameter and the narrowest fiber size distribution.

Thus, for a 1 wt % p-xylene/UHMWPE (MW=$2.0\times10^6$ g/mol) solution, suitable processing temperatures of each zones were found to be $T_1$, $T_2$=130° C., $T_3$~80° C., and $T_4$~75° C. FIG. 3, Panel A shows typical UHMWPE polymer fibers fabricated from the UHMWPE/p-xylene (1 wt %) solution, with organic salt (tetra-butyl ammonium bromide, or t-BABs in short) added (0.2 wt %) to increase the electrical conductivity of the solution.

The spinning solution was then gel-electrospun and only $T_3$ and $T_4$ were varied, while all the other parameters were held constant. Unless stated otherwise, the other processing parameters were held constant as described in the examples above. A series of experiments consistently revealed that $T_3$ and $T_4$ stayed mostly equal throughout the duration of the experiment, with the biggest difference observed at any point being $T_3$=$T_4$+5° C. FIG. 2, Panel B shows the mean diameter and its distribution as a function of $T_3$. The distribution and mean fiber diameter clearly decrease as $T_3$ was increased from room temperature to 80° C. This was expected as the solution viscosity decreased when the temperature was increased up to ~80° C. (FIG. 2, Panel A). As the temperature was raised above 80° C., no obvious trend of fiber diameter nor its distribution was observed. The solution viscosity stayed relatively constant, on the order of 100 Poise above 80° C., which resulted in relatively similar fiber diameters and their distributions. Judging from the suggested preferred gel-electrospinning window of 79° C.≤T≤90° C., the UHMWPE fibers that were collected at $T_3$=80° C. were gel-electrospun.

Example 7—Empirical Relationship Between Fiber Diameter and Modulus

The overall crystallinity of UHMWPE nanofiber mat was around 60%, from analysis of a DSC result. The relatively low degree of crystallinity was largely a result of the polydispersity in fiber diameters within a fiber mat, which ranged from submicron (high crystallinity) to micron (low crystallinity). A wide-angle X-ray diffraction (WAXD) trace of a fiber bundle of d=0.9±0.2 μm (FIG. 4, Panel D) yielded 90% crystallinity (orthorhombic PE crystal). These results provided insights on the trend of mechanical properties between submicron and micron fibers in Table 1 and FIG. 4, Panels B and c. When d>1 μm, the fiber yielded low modulus yet a high strain at break, which are typical mechanical behaviors of a low crystallinity material. When d<1 μm, the fiber behaved like a highly crystalline material, yielding higher modulus and a relatively lower strain at break. These results further confirmed that the low degree of crystallinity observed in a fiber mat was due to the presence of low crystallinity micron fibers among the highly crystalline submicron fibers.

These mechanical enhancements of smaller fibers are the result of larger growth amplitude of the whipping instability, which resulted in higher drawing ratio, better molecular orientation, and thus higher degree of crystallinity. An empirical correlation between the Young's modulus and the fiber diameter was derived from FIG. 4, Panel B. The fitted power-law correlation was $$E=14.83(d^{-2.22})$$

which was a good fit for the data, with the $R^2=0.96$. From this empirical relationship, it is possible to relate the Hencky strain, ε, with the modulus as well. The Hencky strain is defined as follows:

$$\varepsilon = 2\ln\left(\frac{h_0}{h_{mid}(t)}\right)$$

which is an indicator of the extensional strain imposed in the gel-electrospinning process. $h_0$ is the initial diameter of the unstretched fluid filament, assumed to be 100 μm. $h_{mid}(t)$ is a time-dependent diameter of the stretched fluid, which was estimated as the as-spun fiber diameter divided by the square root of the polymer concentration to approximate the terminal jet diameter before the solvent evaporation. From these known parameters, a relationship between the modulus and Hencky strain was derived, $$E=0.0005e^{1.11\varepsilon}$$

implying that the modulus increases exponentially as the Hencky strain increases. This result supports that the higher molecular orientation was induced as the extensional strain of the gel was increased with the whipping instability. The high molecular orientation, which was more pronounced for d<1 μm, synergistically increased the degree of crystallinity and yielded an exponential increase of modulus with the reduction of the fiber diameter.

Example 8—Electrospinning Solution Composition

Several electrospinning solution compositions were examined for a solution that yielded a high productivity and small fiber diameters with a narrow distribution. Table 2 shows the results of electrospinning solution of 1 wt % UHMWPE in several different solvents. In each case, 0.2 wt % of tetra-butyl ammonium bromide (t-BAB) was added to increase the electrical conductivity of the solution up to ~0.2 μS/cm; the addition of this salt facilitated the continuous production of UHMWPE fibers with acceptable production rate. For these preliminary experiments, $T_1$ and $T_2$ were both set at 130° C., which was above $T_{melt}$ and below $T_{boil}$ of all the solvents used. $T_3$ and $T_4$ were fixed at a room temperature. The p-xylene/UHMWPE solution yielded the highest production rate among the good PE solvents tested, and the fiber diameters were relatively small and monodisperse.

TABLE 2

Electrospinning assessment of UHMWPE with different solvents.

| PE Solvent | Productivity (mg/h) | Mean Fiber Diameter (μm) |
|---|---|---|
| decalin | 1.0 | 6.13 ± 2.34 |
| p-xylene | 25 | 2.72 ± 1.33 |

TABLE 2-continued

Electrospinning assessment of UHMWPE with different solvents.

| PE Solvent | Productivity (mg/h) | Mean Fiber Diameter (μm) |
|---|---|---|
| p-xylene: cyclohexanone (1:1 v %) | 5.0 | 3.26 ± 0.74 |

Example 9—Gel-Electrospun Fibers Crystallinity

Figure 11:
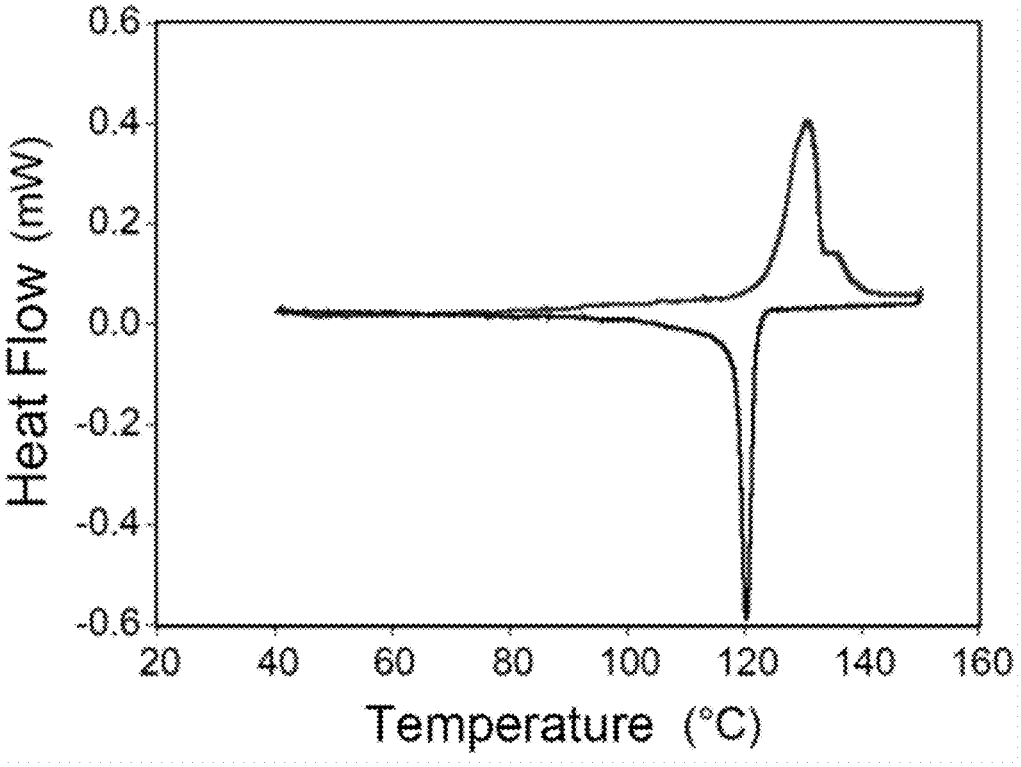
FIG. 11 is a plot of the Differential Scanning calorimeter (DSC) data of p-xylene/UHMWPE gel-electrospun fiber mat.

The crystallinity of the gel-electrospun fibers was examined by DSC, WAXD, and SAED The degree of crystallinity of the UHMWPE fiber mat was calculated from results of both DSC (see FIG. 11) and WAXD (FIG. 8), which yielded values of 56% and 58%, respectively. By contrast, the degree of crystallinity of the fiber bundle having d=1.41±0.60 μm (FIG. 8) was close to 90%, as determined by WAXD and confirmed to be the orthorhombic crystal form of PE based on peak locations. DSC was not used to measure the degree of crystallinity for the fiber bundle sample due to the small amount of the sample available.

Figure 8:
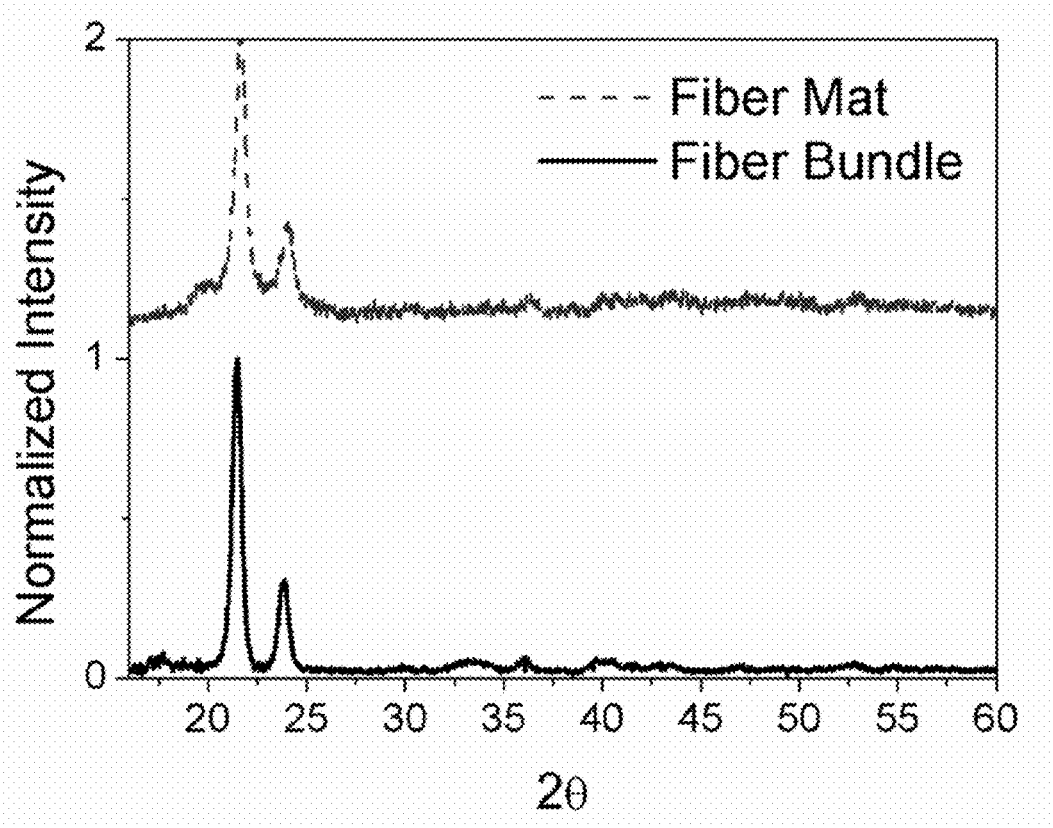
FIG. 8 is a plot of Stacked WAXD traces of the fiber mat (dashed line, top) and the fiber bundle (solid line, bottom).
Figure 9:
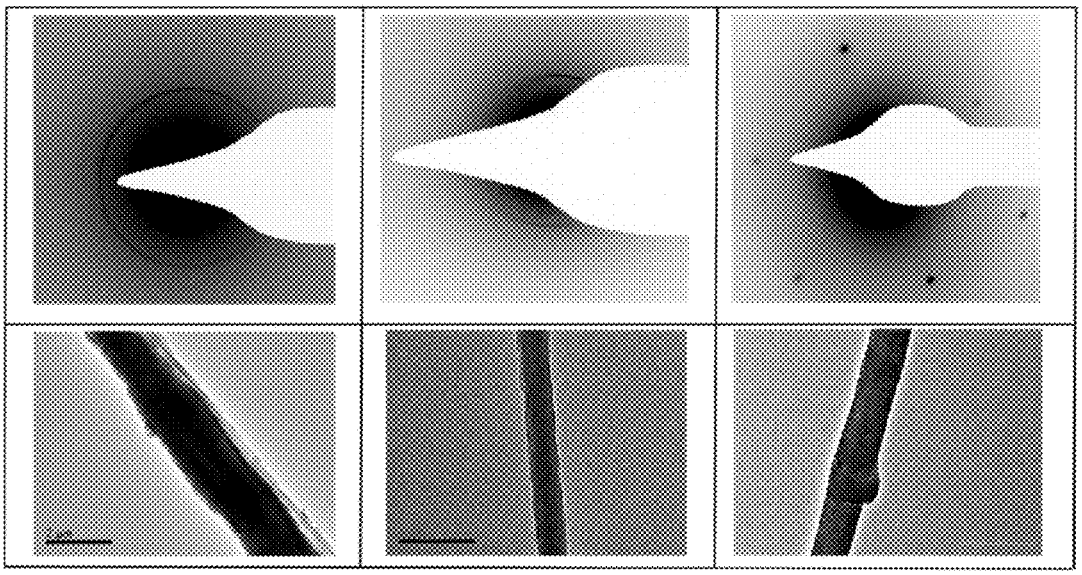
FIG. 9 shows the SAED crystal patterns displayed on the top row, while the bottom row shows the corresponding individual UHMWPE fiber. The scale bars represent 2.0 μm, 1.0 μm, and 0.2 μm from the leftmost column to the rightmost column.

FIG. 9 shows representative SAED patterns and the corresponding TEMs of single UHMWPE fibers with different diameters. All of the patterns in FIG. 9 are indicative of the orthorhombic PE crystal, in accord with the WAXD results (FIG. 8). However, crystal orientation within the fibers became significantly sharper with decreasing diameter. The thickest fiber, d=1.95 μm, showed random crystal orientation, as signified by the ring SAED pattern; other fibers with d>1 μm all displayed such patterns. The thinner fiber in the second column of FIG. 9 (d=0.42 μm) exhibited an arc-shaped reflection, which corresponded to a distribution of orientations of the 110 and 200 lattice planes. Even higher crystal orientation was observed when d=0.11 μm (third column of FIG. **3*d***), whose pattern was that typical of a single crystal.

Example 10—Comparison with Commercial Fibers

Figure 10:
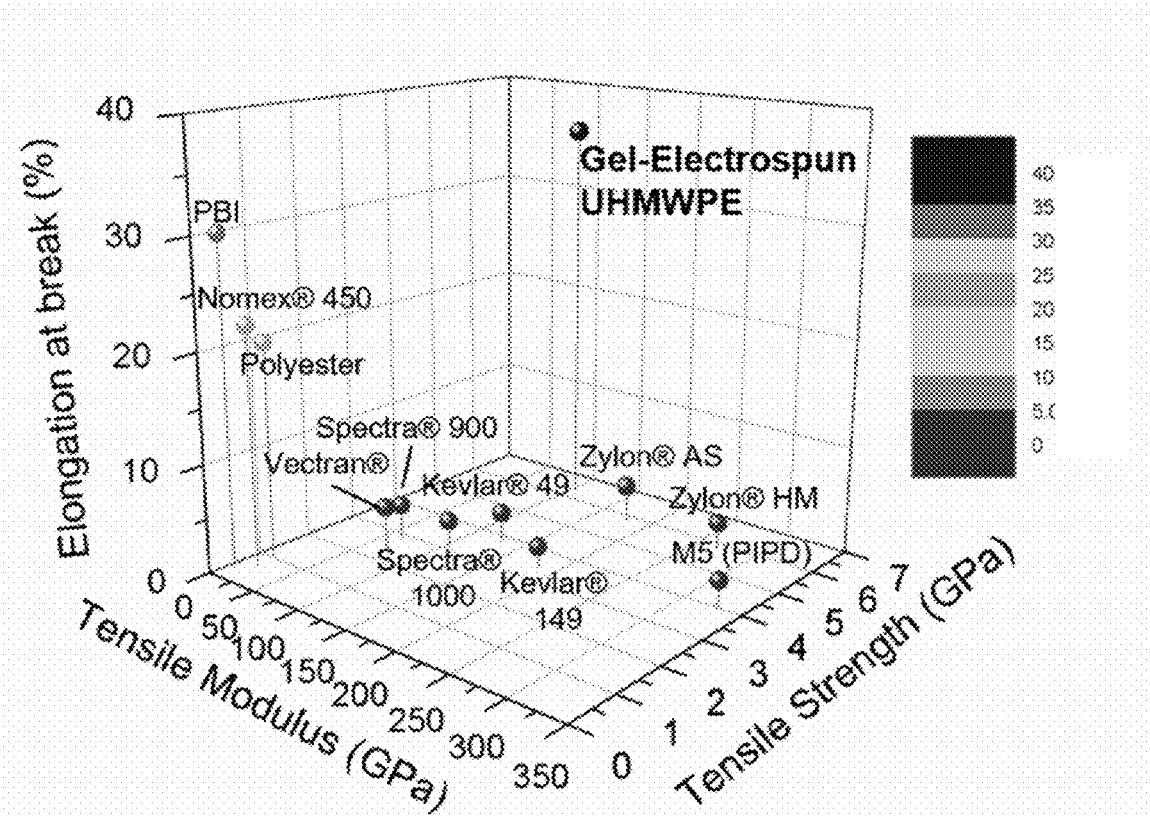
FIG. 10 is a three-dimensional plot of tensile modulus, tensile strength, and elongation break for the highest values of an individual gel-electrospun UHMWPE fiber compared with other commercial polymer fibers. The shading scheme on the right corresponds to the z-axis value (elongation at break [%]) of each data.

FIG. 10 compares the highest mechanical properties attained from the methods disclosed herein with those of other commercial polymer fibers. In general, high performance fibers yielded modulus well above 50 GPa and tensile strength greater than 2.0 GPa, but none exhibited elongation at break above 3-4%. By contrast, more flexible commercial fibers yielded 20-30% strains at break, yet exhibited modest modulus below 20 GPa and strength below 1.0 GPa. The gel-electrospun UHMWPE fiber yielded modulus higher than 100 GPa, a common threshold used to identify a high performance fiber, and remarkably high tensile strength of 6.3 GPa, which even exceeds that of a high modulus Zyron® fiber. This tensile strength is also the highest known among the individual polymer fibers fabricated by any electrostatically-driven jetting process. Even with such high strength and modulus, a high strain at break of 36% was achieved, which is at least a ten-fold increase compared to any other conventional high performance fiber.

Example 11—Wide-Angle X-ray Diffraction (WAXD)

A Bruker D8 with General Area Detector Diffraction System was used to measure the Wide-Angle X-ray Diffraction (WAXD) trace of fiber mats and bundles. Two-dimensional X-ray diffraction patterns were measured, integrated, with a background subtraction to obtain one-dimensional XRD patterns in $15.0° \leq 2\theta \leq 60.0°$. The degree of crystallinity was obtained using $X_{WAXD}=I_{xtal}/(I_{xtal}+I_{amorph})$, where $I_{xtal}$ is the integrated area of the crystalline peaks and $I_{amorph}$ is the integrated area of the amorphous peak. In the case of polyethylene, the crystalline peaks for the 110 and 200 planes were found at $2\theta=21.4°$ and 23.9°, respectively. The amorphous halo was defined as a broad peak in the range $15.0° \leq 2\theta \leq 25.0°$.

INCORPORATION BY REFERENCE

All of the U.S. patents and U.S. published patent applications cited herein are hereby incorporated by reference.

EQUIVALENTS

Those skilled in the art will recognize, or be able to ascertain using no more than routine experimentation, many equivalents to the specific embodiments of the invention described herein. Such equivalents are intended to be encompassed by the following claims.

We claim:

1. A method of forming a plurality of fibers, comprising the steps of:

placing a polymer solution in a vessel comprising a spinneret; wherein the polymer solution comprises a polymer and a solvent, the polymer solution has a gelation temperature and a viscosity, the solvent has a boiling point, the temperature of the polymer solution in the vessel is in the range from the boiling point of the solvent to the gelation temperature, and the viscosity of the polymer solution is less than about 150 Poise;

applying heat to a space separating the spinneret from a collection surface; and electrostatically drawing the polymer solution through the spinneret into an electric field, wherein the temperature of the polymer solution as it is drawn through the spinneret is in the range from about 15° C. below the gelation temperature to the gelation temperature, thereby depositing a plurality of fibers on the collection surface.

2. The method of claim 1, wherein the viscosity of the polymer solution in the vessel is less than about 125 Poise.

3. The method of claim 1, wherein the temperature of the polymer solution in the vessel is in the range from about 15° C. above the gelation temperature to the gelation temperature.

4. The method of claim 1, wherein the temperature of the polymer solution as it is drawn through the spinneret is in the range from about 10° C. below the gelation temperature to the gelation temperature.

5. The method of claim 1, wherein the polymer solution is heated in the vessel.

6. The method of claim 1, wherein the polymer solution is heated prior to being placed in the vessel.

7. The method of claim 6, wherein prior to being placed in the vessel the polymer solution is heated to a temperature in the range from its gelation temperature to the boiling point of the solvent.

8. The method of claim 1, wherein the space between the spinneret and the collection surface is heated to a space temperature in the range from about 15° C. below the gelation temperature to the gelation temperature.

9. The method of claim 1, wherein a positive electrical potential is maintained on the spinneret, and a negative electrical potential is maintained on the collection surface.

10. The method of claim 1, wherein the polymer solution comprises ultra-high molecular weight polyethylene (UHMWPE).

11. The method of claim 1, wherein the solvent comprises decalin, o-dichlorobenzene, p-xylene, cyclohexanone, or paraffin oil.

12. The method of claim 1, wherein the collection surface is at a temperature in the range from about 15° C. below the gelation temperature to the gelation temperature.

13. The method of claim 1, wherein the polymer solution further comprises a salt.

14. The method of claim 13, wherein the salt is tetra-butyl ammonium bromide (t-BAB) or tetra-butylammonium hydrogen sulfate (t-BAHS).

* * * * *